US006050606A

United States Patent [19]

Foresti

[11] Patent Number: 6,050,606

[45] Date of Patent: Apr. 18, 2000

[54] SAFETY DRAWING FOR SECURITIES

[75] Inventor: Gianfranco Foresti, Bussigny, Switzerland

[73] Assignee: De La Rue Giori S.A., Lausanne, Switzerland

[21] Appl. No.: 09/090,079

[22] Filed: Jun. 3, 1998

[30] Foreign Application Priority Data

Jun. 6, 1997 [CH] Switzerland ..... 1381/97

[51] Int. Cl.[7] ..... B42D 15/00

[52] U.S. Cl. ..... 283/93; 283/114; 283/901; 283/902

[58] Field of Search ..... 283/93, 114, 901, 283/902

[56] References Cited

U.S. PATENT DOCUMENTS

| | | | |
|---|---|---|---|
| 3,147,699 | 9/1964 | Land | 101/211 |
| 4,040,353 | 8/1977 | Lefebvre | 283/93 |
| 5,443,579 | 8/1995 | Tanaka et al. | 283/93 |
| 5,487,567 | 1/1996 | Volpe | 283/93 |
| 5,853,197 | 12/1998 | Mowry, Jr. et al. | 283/93 |

FOREIGN PATENT DOCUMENTS

| | | |
|---|---|---|
| 55 1205 | 7/1993 | European Pat. Off. . |
| 614 133 | 9/1994 | European Pat. Off. . |

*Primary Examiner*—Andrea L. Pitts
*Assistant Examiner*—Monica Smith
*Attorney, Agent, or Firm*—Pitney, Hardin, Kipp & Szuch, LLP

[57] ABSTRACT

The drawing has a background (10) composed of at least a first region and a second region juxtaposed. Each of said regions comprises its own geometrical drawing so that the first region has a color density which is stronger than that of the second region, said second region forming a pattern. An overprint (20) corresponding to said overprint is printed over the second region, said overprint (20) comprising geometrical drawings different than that of said second region and in a color chosen to compensate the difference of color density between said regions, so that the safety drawing appears uniform and with no pattern to the naked eye, but said pattern is clearly brought out and in another color than that of the first region on a photocopy of the safety drawing.

15 Claims, 5 Drawing Sheets

SAFETY DRAWING FOR SECURITIES

FIELD OF THE INVENTION

The present invention concerns a safety drawing for securities, notably bank notes, securities comprising such drawing and a process for printing such safety drawing on securities.

One of the main problems which actually exists in the production of securities is to design safety elements which are, on one hand, easy to transfer on bank notes with classic printing techniques, and which, on the other hand, are very difficult or even impossible to reproduce, in particular with the new generation of colour photocopier. Their technology having notably improved, it becomes indispensable to realise safety drawings that are such that it becomes very easy to distinguish a colour copy, e.g. counterfeit money, from genuine securities or bank notes.

PRIOR ART

The use of safety drawings to prevent falsification of securities by colour photocopy is known in the prior art. European Patent Application EP 0 384 897, for example, assigned to the same applicant, discloses a safety element mainly composed of three superposed drawings, each drawing being of a different colour and comprising angularity oriented parallel lines, the lines of each drawing being laterally offset so that when the drawings are juxtaposed, the lines do not overlap but give the impression of a uniform background. Each safety element additionally comprises zones in which segments of lines have another orientation than that of the parallel lines, so that these are discontinuous. These zones correspond in fact exactly to letters which become nearly invisible to the naked eye when the drawings are superposed but which, on the contrary, are clearly brought out when one makes a photocopy of the safety element. It is thus possible to establish immediately and in a very easy way whether a given note is an original one or a copy, when such note comprises such a safety element.

SUMMARY OF THE INVENTION

The present invention has the aim of improving the safety elements known from the prior art, and more particularly to design a safety drawing comprising a pattern in a latent colour, which is invisible or nearly invisible to the naked eye on genuine securities, the latent colour pattern being clearly disclosed on a colour photocopy of said securities, and this also on copies made by last generation photocopiers.

This aim is fulfilled by a safety drawing according to claim 1.

The principle of the invention is based on the fact that, on one hand, the background of the drawing is made of two regions with straight lines and curved lines, both regions having a different colour density, and the region with the weakest colour density forming a pattern. The safety drawing additionally comprises an overprint corresponding to the pattern which is printed over said region of weaker colour density with a colour chosen to compensate the colour density difference between both regions, thus forming a latent colour pattern, so that the safety drawing appears uniform and with no pattern to the naked eye but the pattern is brought out in a different colour than that of the region with the strongest colour density on a photocopy of the safety drawing.

In effect, on a photocopy, the combination of different densities and shades of colours creates interferences for the scanner of the photocopier. The contrast between the drawing background and the pattern will be strongly amplified and the latter will appear clearly on the copy and in another colour than that of the rest of the safety drawing, making such falsification obvious to the naked eye and allowing to easily distinguish a photocopy from an original.

Dependent claims 2 to 11 define particular embodiments of the safety drawing according to the invention.

The pattern or drawing in latent colour is preferably a letter or a sign, such as "X" or an assembly of letters forming a word such as "VOID" or "COPY". It may also comprise one or several numbers, or even any other pattern.

Independent claim 12 defines a note of value comprising a safety drawing according to the present invention. The use of such safety drawings is of course not restricted to notes of value, such as securities or bank notes. Actually, this safety drawing may also be used on cards, such as credit cards or others, checks or even stamps. In fact, one may use such drawing on any printed medium, which one wishes to avoid the counterfeiting by means such as photocopy.

Independent claim 13 defines a process for producing securities comprising a safety drawing according to the present invention.

Dependent claims 14 and 15 define particular printing processes used for producing securities comprising a safety drawing according to the present invention.

BRIEF DESCRIPTION OF THE DRAWINGS

Colour figures representing the present invention are filed with the present application as FIGS. 5 and 6, the principle of the invention being very difficult to prove with black-and-white photocopies. The file of this patent contains at least one drawing executed in color. Copies of this patent with color drawings will be provided by the Patent and Trademark Office upon request and payment of the necessary fee.

The invention will be best understood by the description of an embodiment of the invention and of the corresponding drawings which illustrate the principle of the invention.

DESCRIPTION OF THE PREFERRED EMBODIMENTS

Figure 1:
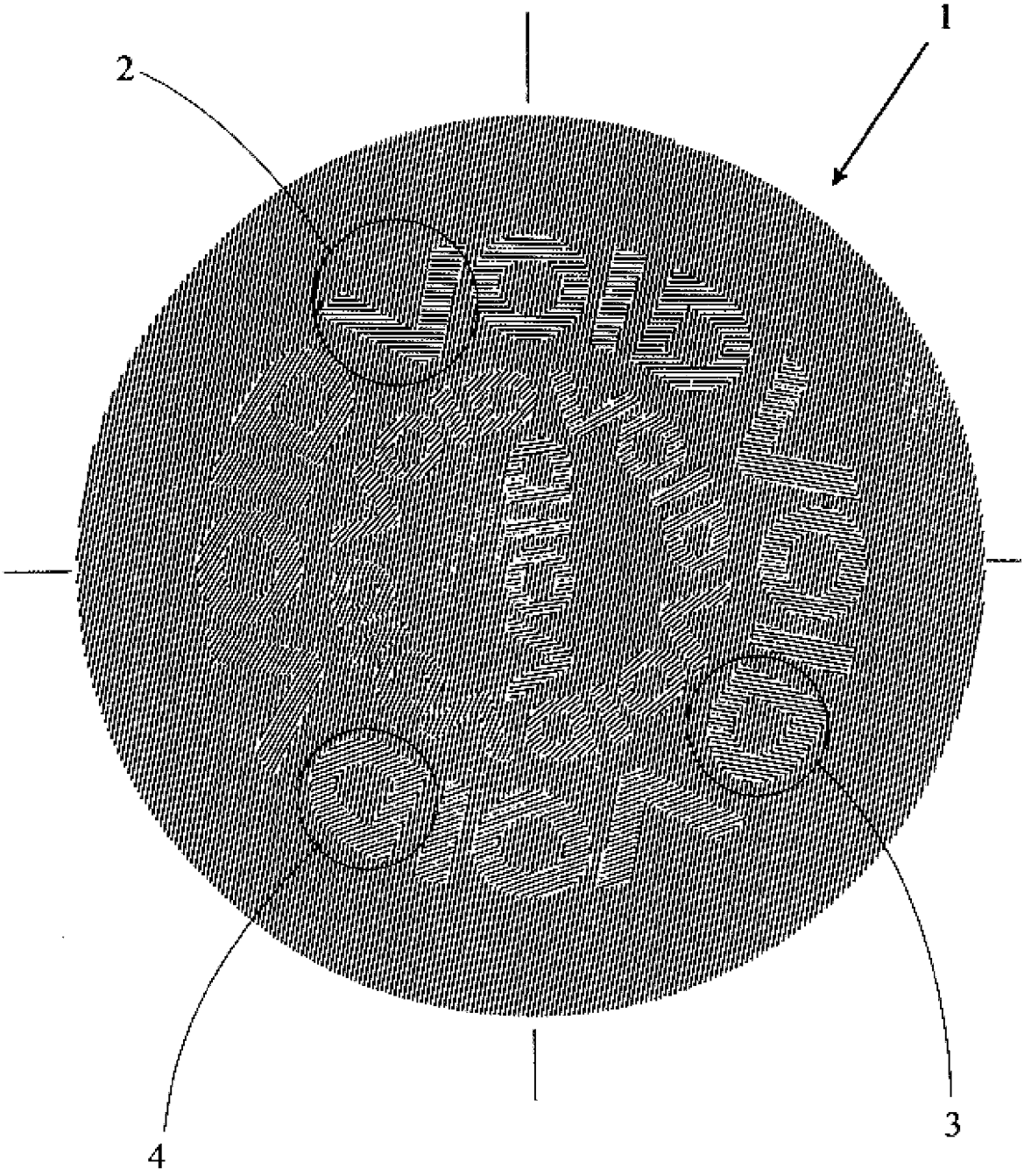
PRIOR ART Fig.1
FIG. 1 represents a safety drawing according to the prior art.

On FIG. 1, a safety element of the prior art according to the European Patent Application EP 0 384 897 is represented. The three drawings of three different colours have already been superposed as an assembly 1 of parallel and dense lines and give the impression of a uniform background. The safety drawing comprises the zones 2, 3, 4 in which the parallel lines are oriented in another direction than the general direction of the background lines, these zones having the shape of letters building the word "VOID". The figure being a enlargement of the safety drawing and already a copy of said drawing, the word is easily recognisable on it. If one considers the real size of such safety drawings, then these words are far more difficult to distinguish on an original drawing. On the other hand, all lines are straight lines or segments of straight lines.

Figure 2:
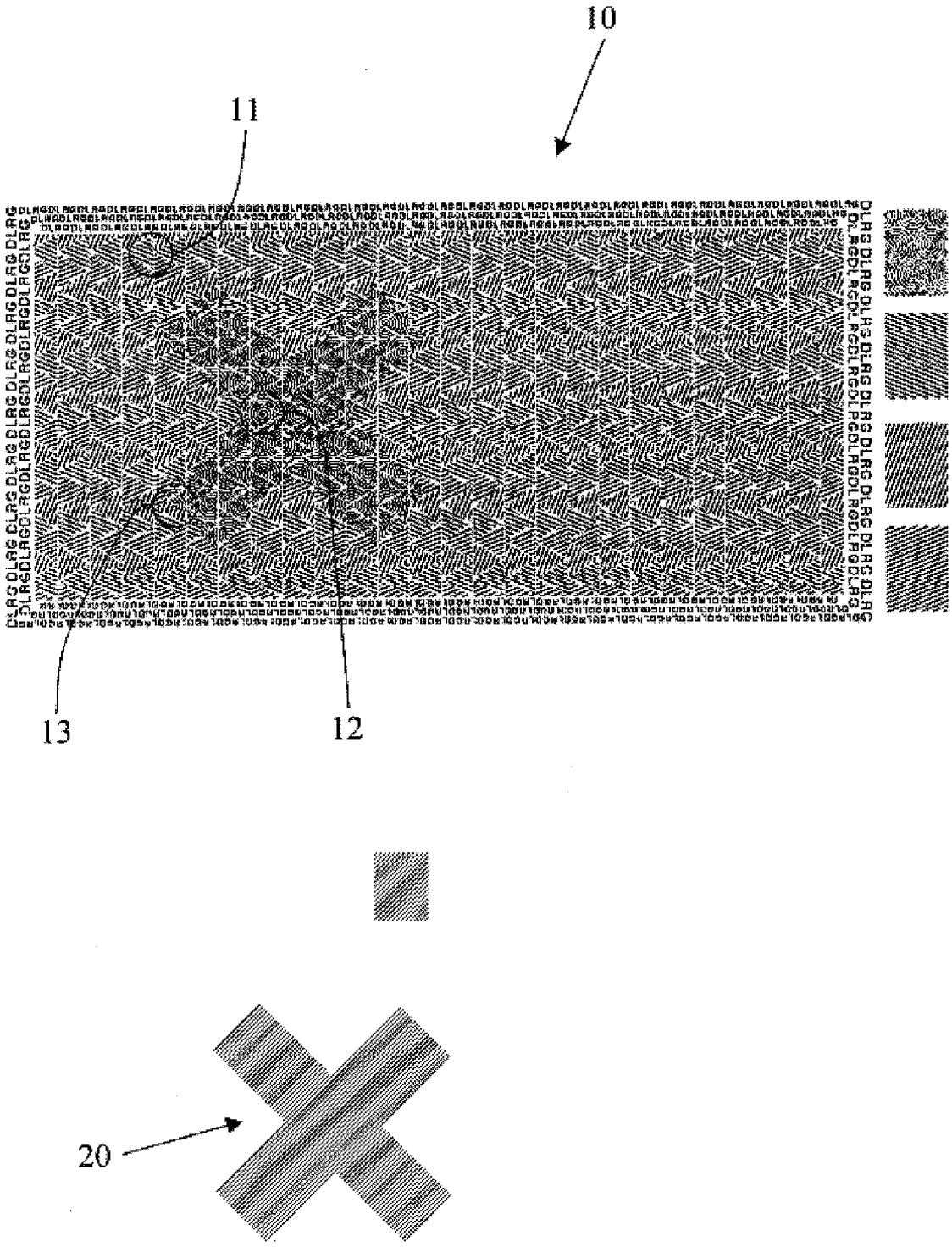
FIG. 2 represents an example according to the invention, in black-and-white, of the background of a safety drawing and of a pattern or latent drawing in form of a cross, the background and the latent drawing being shown separately.

On FIG. 2, the background 10 of a safety drawing according to the invention is represented with, next to said background, an overprint 20 having the shape of a cross, said overprint 20 meant to be printed on the background 10. The shades of colour are of course difficult to show with photocopies but this model is given as an example.

The background 10 of the safety drawing is divided into regions comprising triangular geometrical zones 11 placed alternately one next to the other. In this example, there are 3 types of zones with different configuration of lines. The first type of zone 11 only comprises parallel straight lines. Among this type of lines with this first configuration, one can distinguish zones 11*a* with straight lines oriented angularly in a first direction, zones 11*b* with straight lines oriented angularly in a second direction and zones 11*c* with straight lines oriented angularly in a third direction. The background furthermore comprises a second type of zones 12 having curved lines in the shape of spiral and a third type of zones comprising a mix of parallel segments of straight lines angularly oriented and segments of spiral lines. The impression of the lines and of the spirals is done in such a way that they form a pattern corresponding to the overprint 20 to be printed in superposition, in the described example an "X".

The overprint 20 of this embodiment has the shape of an "X" also comprising parallel lines oriented in a given angular direction, for example 45°. During printing of this overprint 20 on the background, a superposition of straight and curved lines will effectively occur such as a superposition of colours compensating the difference of colour density.

The angles of orientation of the parallel lines of the background and of the overprint may have any value, the important thing being that the background has at least lines oriented in two different directions, and that the overprint lines are oriented in a direction different than that of the two others. Preferably, the parallel lines are oriented at about 22,5° and 67,5°, and the lines of the overprint are oriented at about 45°. If the background comprises lines oriented in a third direction, the chosen angle is preferably 112,5°. These values have a margin of about ±20%.

The width of the lines printed in parallel, of the spiral lines and of the lines of the overprint is also variable. It may vary between about 15 μm and 100 μm. Preferably, the lines printed in parallel have a width of about 82,55 μm and the curved lines a width of about 41,275 μm. In addition, the lines of the overprint preferably have a width of about 41,275 μm. These values have a margin of about ±20%.

The distance between each printed line, measured between the centre of two adjacent lines, what is called the pitch, may vary between about 100 μm and 800 μm. The chosen value depends on the uniformity one wants to obtain for the background and for the overprint. Preferably, this distance is about 349,25 μm for the parallel lines of the background, about 247,65 μm for the overprint and about 250 μm for the curved lines. These values have a margin of about ±20%.

The colour density of the overprint which is meant to be printed in superposition is about 0,010 to 0,300.

The zones of the background containing the lines may have any geometrical shape, for example a triangular shape, hexagonal, rectangular, circular etc.

Figure 3:
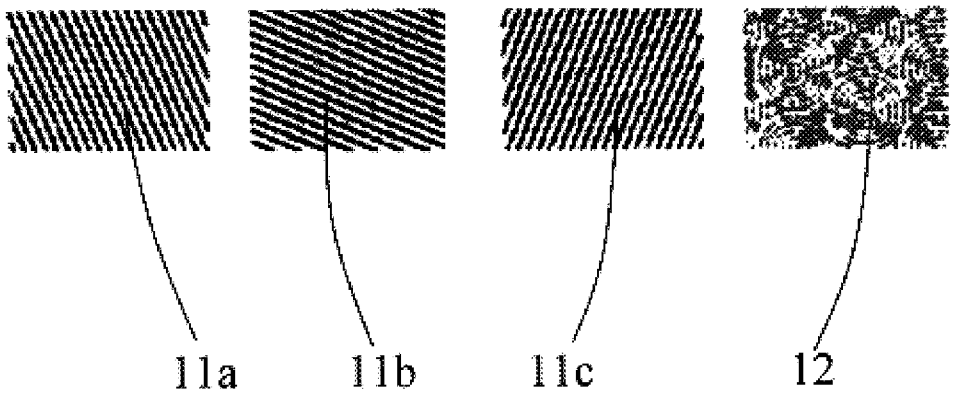
FIG. 3 shows an enlargement of several geometrical patterns of the background.

On FIG. 3, an enlargement of the geometrical drawings which are in the zones 11 and 12 is given. One finds segments of parallel lines and oriented in three different directions corresponding to that of zones 11*a*, 11*b*, 11*c* and segments of spirally curved lines corresponding to that of zones 12.

Figure 4:
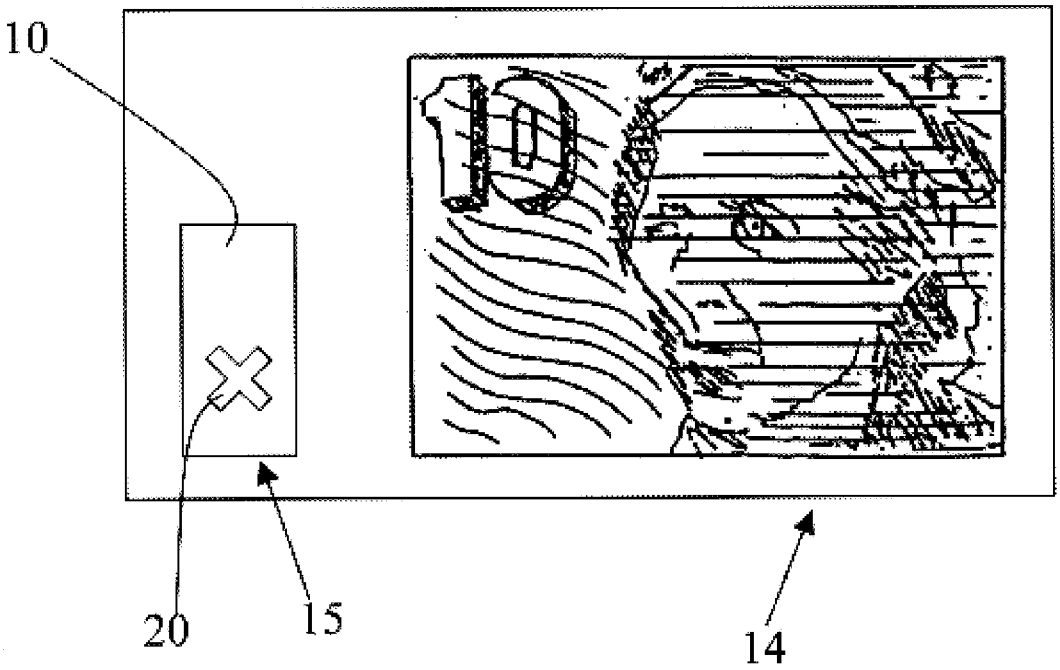
FIG. 4 shows a diagrammatic reduced representation of a banknote with the safety drawing according the invention.

On FIG. 4, a banknote 14 with a safety drawing 15 according to the invention is schematically represented for illustration purposes. The safety drawing 15 is composed, as described, of a background and of an overprint. Such safety drawing may be printed on one side of the banknote or on both sides.

Figure 5:
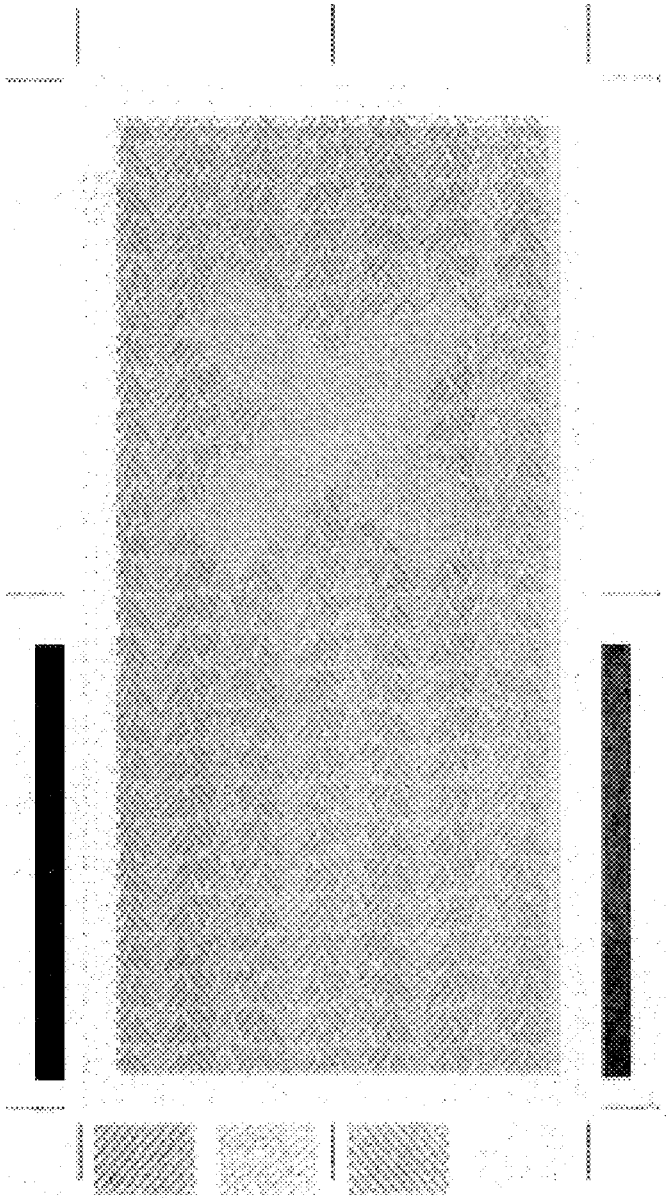
FIG. 5 represents a colour photography of a safety drawing with a pattern in the shape of an "X" according to the invention.

FIG. 5 represents a colour photography of a safety drawing according to the invention with the "X"-shaped pattern printed in superposition on a background. The background of this safety drawing corresponds to the background 10 of the embodiment described in reference to FIG. 2, with alternated triangular zones with lines oriented in three different directions and the pattern corresponding to the overprint 20 described in reference to FIG. 2. On this photography, the pattern in latent colour is difficult to distinguish from the background which, on its side, presents a uniform appearance at first sight.

Figure 6:
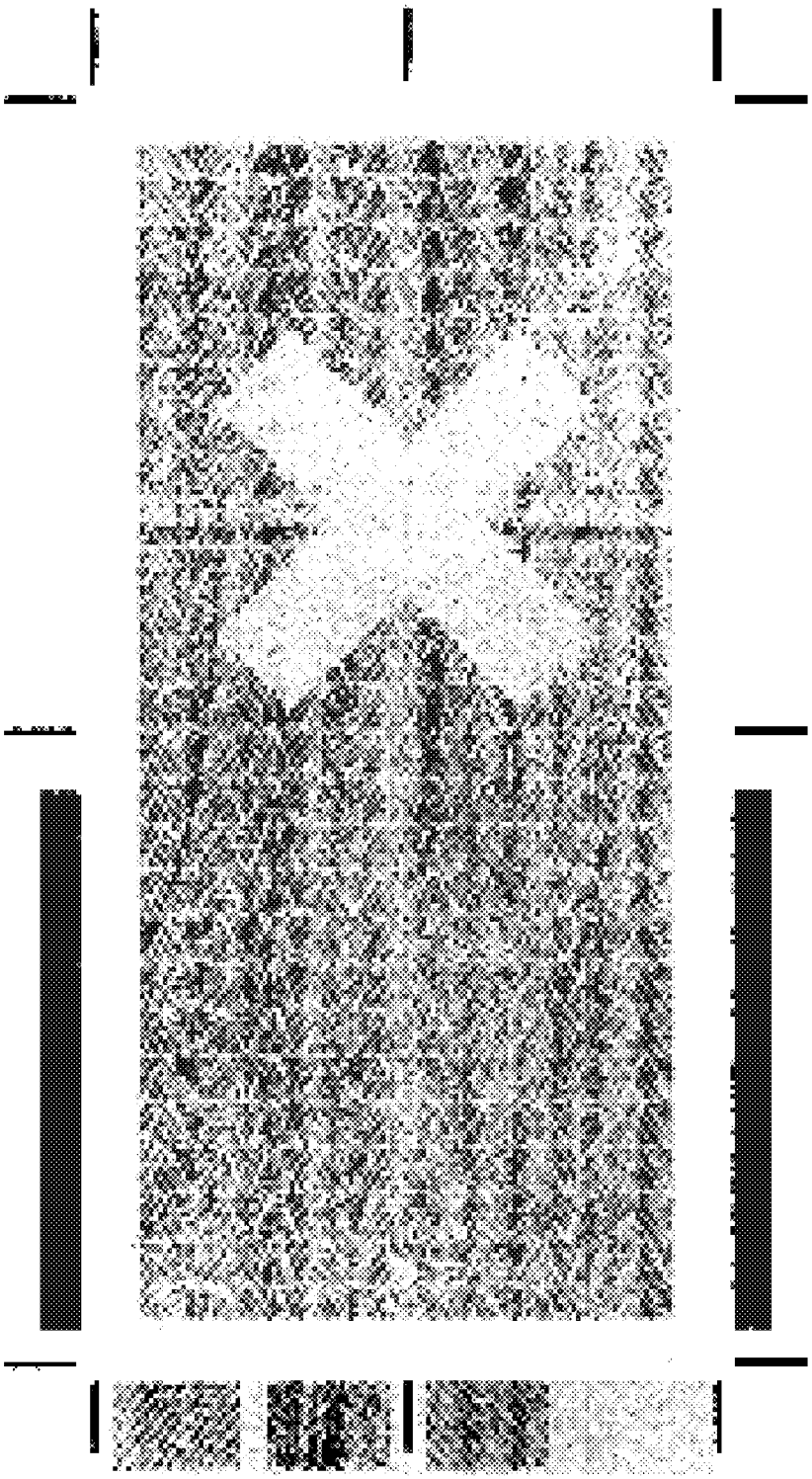
FIG. 6 represents a colour photocopy of the photography of FIG. 5.

On FIG. 6, a colour photocopy of the safety drawing of FIG. 5 is represented. On this photocopy, the pattern in latent colour is clearly brought out in the safety drawing and in an univocal way, the contrast and the difference of colour between the background and the pattern being distinctly marked.

Safety drawings according to the invention are made by classical printing processes, such as: dry or wet offset, intaglio or a combination of them. In the case of an offset process, two plates at least are necessary, one for the background and the other one for the overprint. These plates may of course contain other additional patterns and they are mounted on an offset plate cylinder. The drawings are then transferred on a blanket cylinder which transfers them on the paper itself. Such multicolour offset printing processes are disclosed in European Patents EP B 0 092 887 and EP B 0 132 858, for example.

In the case of a combination of different printing processes, one may for example use an intaglio process for the background and an offset process for the overprint.

The process of printing of a safety drawing according to the invention on securities or on a bank note comprises at least the two following steps:

impression with a first printing plate of a background composed of at least a first region and a second region juxtaposed, said regions each comprising their own geometrical drawing, in such a way that the first region has a colour density which is stronger than that of the second region, the second region forming a pattern, impression with a second printing plate of an overprint superposed over said second region in a colour chosen to compensate the difference of colour density between both regions, so that the safety drawing appears uniform and with no pattern to the naked eye, but said pattern is clearly brought out and in another colour than the first region on a photocopy of the safety drawing.

It is also possible to increase the number of colours in the safety drawing. For example, the geometrical drawings of the background may be of different colours, and the overprint made of several colours. In this case, the number of printing plates must also be consequently increased.

The invention is not limited to the embodiment described, but other variants are possible in the scope of the claimed protection.

For example, one may print the spiral lines on the overprint and leave on the background only parallel lines oriented according to different directions. The same effect of alternate straight and curved lines is thus repeated and the principle of the invention reproduced.

Other shape of geometrical zones are possible, for example hexagonal, circular or any other shape.

Instead of spirals, one may use, as curved lines, concentrical circles, or ellipses, or undulations or even other equivalents.

What is claimed is:

1. Safety drawing for securities, notably bank notes, having a background composed of at least a first region and a second region juxtaposed, wherein said regions each comprise their own geometrical drawings so that the first region has a colour density stronger than that of the second region, said second region forming a pattern, and wherein on said second region an overprint (20) corresponding to said pattern is superposed, said overprint (20) comprising geometrical drawings different than that of said second region and in a colour chosen in order to compensate the difference in colour density between said regions, so that the safety drawing appears uniform and with no pattern to the naked eye, but said pattern is clearly brought out and in another colour than that of said first region on a photocopy of the safety drawing.

2. Safety drawing according to claim 1, wherein the region of stronger colour density comprises groups of lines (11*a*,11*b*) printed in parallel and angularly oriented according to two different directions, and the other region comprises curved lines (12) or straight lines, and wherein the overprint (20) comprises straight or curved lines such that the lines of the overprint cross the lines of said region of weaker colour density when the superposition is carried out.

3. Safety drawing according to claim 2, wherein said groups of lines and said straight and curved lines are arranged in closed geometrical zones (11).

4. Safety drawing according to claim 2, wherein the curved lines of the region of weaker colour density are spirals and the lines of the overprint (20) are straight lines.

5. Safety drawing according to claim 2, wherein the angle of the lines (11*a*,11*b*) oriented according to a first direction is about 22,5°, according to a second direction is about 67,5° and the angle of the lines of the overprint (20) is about 45°, these values having a margin of ±20%.

6. Safety drawing according to claim 2, the drawing comprises zones (11*c*) with parallel lines oriented according to a third direction and in that the angle according to the third direction is about 112,5°, with a margin of ±20%.

7. Safety drawing according to claim 2, the width of the straight lines is about 90 μm and the distance between the different lines of a same zone taken between the centre of each line is about 350 μm, with a margin of ±20%.

8. Safety drawing according to claim 2, the width of the curved lines is about 41 μm and the distance between each curved line taken between the centre of each line is about 250 μm, with a margin of ±20%.

9. Safety drawing according to claim 1, wherein the colour density of the overprint (20) is about 0,010 to 0,300.

10. Safety drawing according to claim 3, wherein said zones (11) have a triangular shape, or rectangular, or hexagonal, or circular or other.

11. Safety drawing according to claim 1, said geometrical drawings are of different colours and said overprint (20) is composed of several colours.

12. Note of value comprising it on at least one of its sides a safety drawing according to claim 1.

13. Process for printing a safety drawing on securities, notably bank notes, comprising the following steps:

impression with a first printing plate of a background composed of at least a first region and a second region juxtaposed, each of said regions comprising their own geometrical drawing, in such a way that the first region has a colour density which is stronger than that of the second region, the second region forming a pattern, impression with a second printing plate of an overprint superposed over said second region in a colour chosen to compensate the difference of colour density between both regions, so that the safety drawing appears uniform and with no pattern to the naked eye, but said pattern is clearly brought out and in another colour than the first region on a photocopy of the safety drawing.

14. Process according to claim 13, wherein one uses as many printing plates as they are different colours.

15. Process according to claim 14, wherein the printing process used is an offset process or an intaglio process.

* * * * *

UNITED STATES PATENT AND TRADEMARK OFFICE

CERTIFICATE OF CORRECTION

PATENT NO. : 6,050,606

DATED : April 18, 2000

INVENTOR(S) : Gianfranco Foresti

It is certified that error appears in the above-identified patent and that said Letters Patent are hereby corrected as shown below:

In the Claims:

In Claim 6, line 1, after "claim 2," please insert —wherein–;

In Claim 7, line 1, after "claim 2, " insert –wherein–;
In Claim 8, line 1, after "claim 2" insert –wherein–;
In Claim 11, line 1, after "claim 1" insert –wherein–;
In Claim 12, line 1, after "comprising" delete "it".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*